US005539768A

United States Patent [19]

Kracich

[11] Patent Number: 5,539,768

[45] Date of Patent: Jul. 23, 1996

[54] ELECTRIC ARC FURNACE ELECTRODE CONSUMPTION ANALYZER

[75] Inventor: Richard E. Kracich, Valparaiso, Ind.

[73] Assignee: LTV Steel Company, Inc., Cleveland, Ohio

[21] Appl. No.: 408,041

[22] Filed: Mar. 21, 1995

[51] Int. Cl.[6] ..... H05B 7/148

[52] U.S. Cl. ..... 373/105; 373/50; 373/106

[58] Field of Search ..... 373/102, 105, 373/94, 50, 47, 49, 104, 106, 108

[56] References Cited

U.S. PATENT DOCUMENTS

| | | | |
|---|---|---|---|
| 3,187,159 | 6/1965 | Kilian | 373/70 |
| 3,272,905 | 9/1966 | Wooding | 373/70 |
| 3,300,562 | 1/1967 | Moore | 373/106 |
| 3,381,079 | 4/1968 | Murtland, Jr. et al. | 373/70 |
| 3,385,920 | 5/1968 | Harbaugh et al. | 373/70 |
| 3,914,526 | 10/1975 | Markarian et al. | 373/105 |
| 3,937,869 | 2/1976 | Markarian et al. | 373/105 |
| 4,048,556 | 9/1977 | Roach et al. | 324/226 |
| 4,131,754 | 12/1978 | Roberts | 373/70 |
| 4,213,955 | 7/1980 | Casciani et al. | 423/442 |
| 4,324,944 | 4/1982 | Weihrich et al. | 373/105 |
| 4,530,102 | 7/1985 | Baker et al. | 373/105 |
| 4,586,187 | 4/1986 | Hein et al. | 373/106 |
| 4,646,318 | 2/1987 | Nordmeyer et al. | 373/105 |
| 4,843,234 | 6/1989 | Berthold et al. | 356/383 |
| 4,881,239 | 11/1989 | Stenzel et al. | 373/70 |
| 4,903,278 | 2/1990 | Koenig et al. | 373/97 |
| 5,099,438 | 3/1992 | Gulden, Jr. et al. | 364/550 |
| 5,467,366 | 11/1995 | Wilhelmi et al. | 373/85 |

FOREIGN PATENT DOCUMENTS

| | | |
|---|---|---|
| 290485 | 2/1971 | U.S.S.R. . |
| 411669 | 5/1974 | U.S.S.R. . |

*Primary Examiner*—Tu Hoang

*Attorney, Agent, or Firm*—Watts, Hoffmann, Fisher & Heinke Co.

[57] ABSTRACT

An electric arc furnace includes at least one electrode projecting into a furnace vessel for containing a charge to be heated and electrode support structure for moving the electrode in a direction along a path towards and away from the charge. An improvement to the electric arc furnace comprises a sensor for detecting the position of the electrode support structure from an initial position. A processor calculates one of a support structure travel distance from the initial position and a rate of electrode consumption. An alarm signal is generated in response to at least one of the travel distance and the rate of electrode consumption being at least equal to a respective predetermined threshold travel distance or a predetermined threshold rate of electrode consumption, either of which is indicative of an excess electrode consumption condition for a given heat. A power reducer automatically decreases electrical power supplied to the electrode in response to the alarm signal being generated and as a function of a magnitude of the excess electrode consumption.

13 Claims, 3 Drawing Sheets

ELECTRIC ARC FURNACE ELECTRODE CONSUMPTION ANALYZER

BACKGROUND OF THE INVENTION

1. Technical Field

The present invention relates generally to electric arc furnaces of the type typically used in the initial or reheat operations in the production of a metal, such as steel. In particular, the present invention relates to a method and apparatus for determining an amount of carbon electrode that is consumed during the production of a particular heat of the metal.

2. Description of the Prior Art

Carbon electrodes are typically used for applying electrical power to melt or reheat a charge contained in a furnace or ladle to produce a steel alloy of a certain chemical makeup or "chemistry". The carbon content in a steel alloy heat is very important. Often, however, the carbon of the electrode wears or is consumed during a heat at a rate that was not predicted or desired for a given steel alloy heat of a specified carbon content. When the resultant carbon content of the steel alloy heat is outside, usually above, the specified range for a given steel being produced, it must be scrapped or otherwise disposed of. Such disposal may take the form of further processing by making it into a steel of a "chemistry" that may not have an immediate market but is nonetheless useable.

An excessive carbon electrode consumption condition also occurs when, for example, the carbon electrode breaks and falls into the furnace to mix with the charge. Another way that the carbon electrode is consumed at an undesired or nonpredicted way is when a "butt joint" region in the electrode is encountered at an arc generating portion of the electrode. The butt joint region is typically consumed at a faster rate than normally would be consumed in a non-butt joint region of the electrode. However, excessive carbon electrode consumption most typically occurs during a normal reheating process, such as during ladle refining of a charge. The excessive consumption has varying magnitude depending on variables such as steel and slag chemistries or slag thickness.

Thus, a need exists for an apparatus and/or method that is able to predict when an excess carbon electrode consumption condition can exist during a heat and provides a way to enable or take corrective action when the excess consumption condition exists to prevent scrapping of a particular steel alloy heat or the need for further corrective processing.

SUMMARY OF THE INVENTION

The method and apparatus of the present invention is directed to monitoring an operation in steel production for a condition of excess carbon electrode consumption and generating an alarm signal so corrective action can be taken when the condition does exist. The present invention, thus, provides a way to reduce scrap heats and to be more productive by providing more "on chemistry" heats.

An electric arc furnace includes at least one electrode projecting into a furnace vessel that contains a charge of molten metal. The furnace also includes electrode support structure for moving the electrode in a direction along a path towards and away from the charge. An improvement to the electric arc furnace comprises a sensor for detecting the position of the electrode support structure from an initial position. A processor calculates a support travel distance from the initial position and/or a rate of electrode consumption. An alarm signal is generated in response to the travel distance or the rate of electrode consumption being at least equal to a respective predetermined threshold travel distance or a predetermined threshold rate of electrode consumption, either of which is indicative of an excess electrode consumption condition for a given heat.

A power reducer decreases electrical power supplied to the electrode in response to the alarm signal being generated. The power reducer may automatically decrease power as a function of the magnitude of the excess electrode consumption.

Also disclosed is a method of reheating a charge in an electric arc furnace which includes at least one electrode projecting into the furnace and electrode support structure for moving the electrode in a direction along a path towards and away from the charge. The method comprises the steps of determining the position of the electrode support structure from an initial position. One of a support travel distance and a rate of electrode consumption is calculated. An alarm signal is generated in response to one of the travel distance and the rate of electrode consumption being at least equal to a respective predetermined threshold travel distance or a predetermined rate of electrode consumption, either of which is indicative of an excess electrode consumption condition for a given heat.

The method may further include the step of decreasing the electrical power supplied to the electrode in response to the alarm signal being generated. The decreasing step preferably includes the step of automatically decreasing the electrical power supplied to the electrode as a function of the magnitude of excess electrode consumption.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENTS

Figure 1:
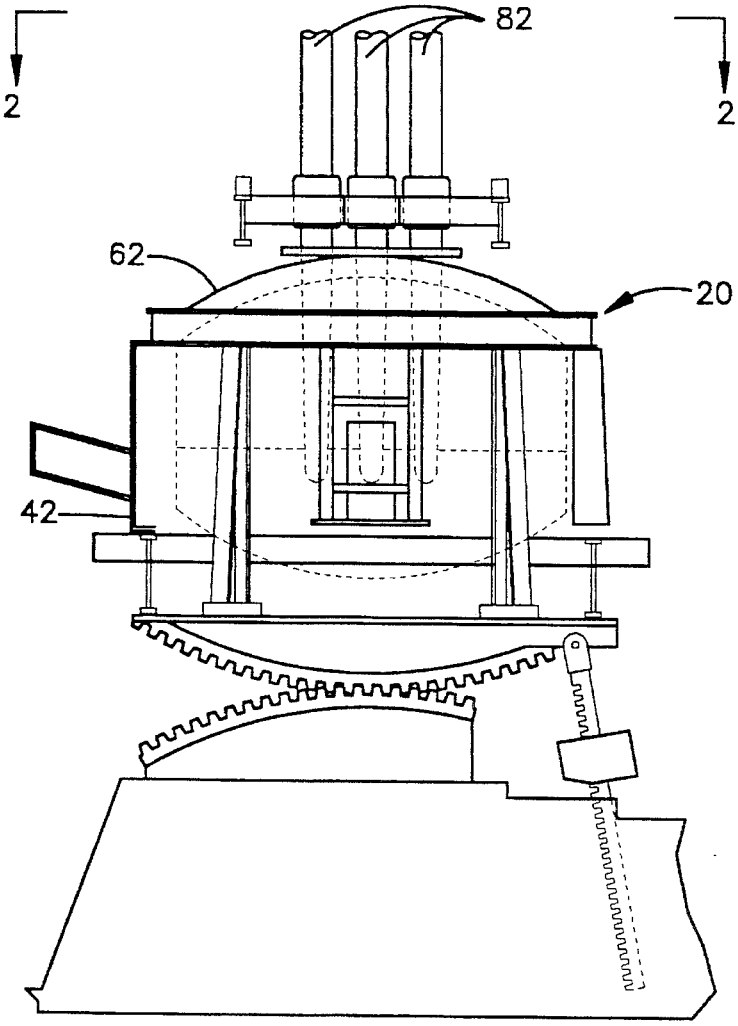
FIG. 1 is a side elevational view of an electric arc ladle refining furnace having an electrode consumption analyzer embodying the present invention.
Figure 2:
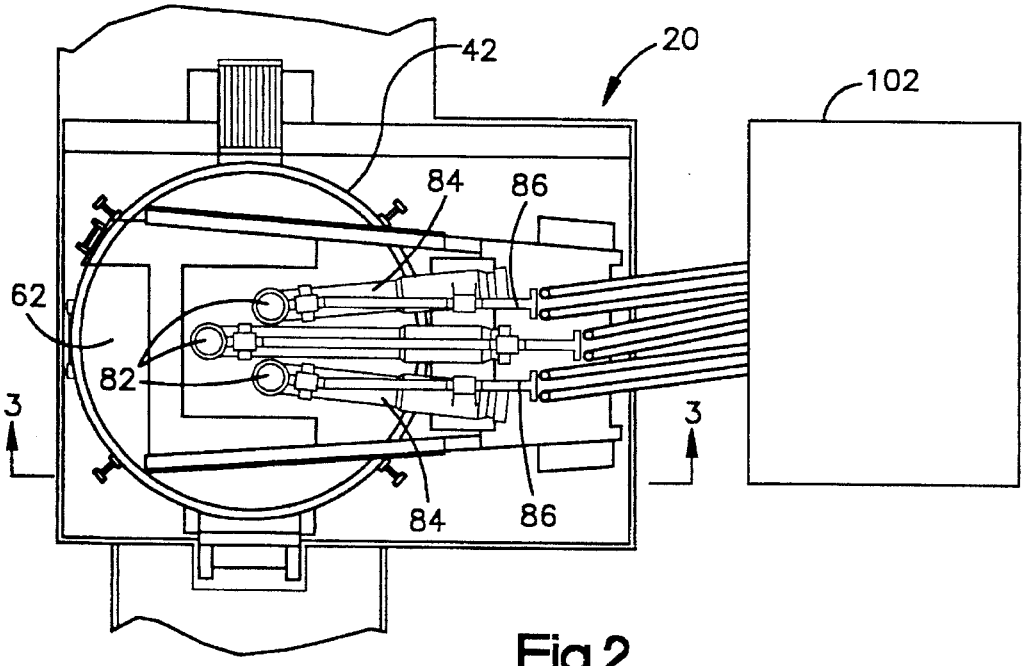
FIG. 2 is a top plan view of the furnace in FIG. 1, taken approximately along line 2—2 of FIG. 1.
Figure 3:
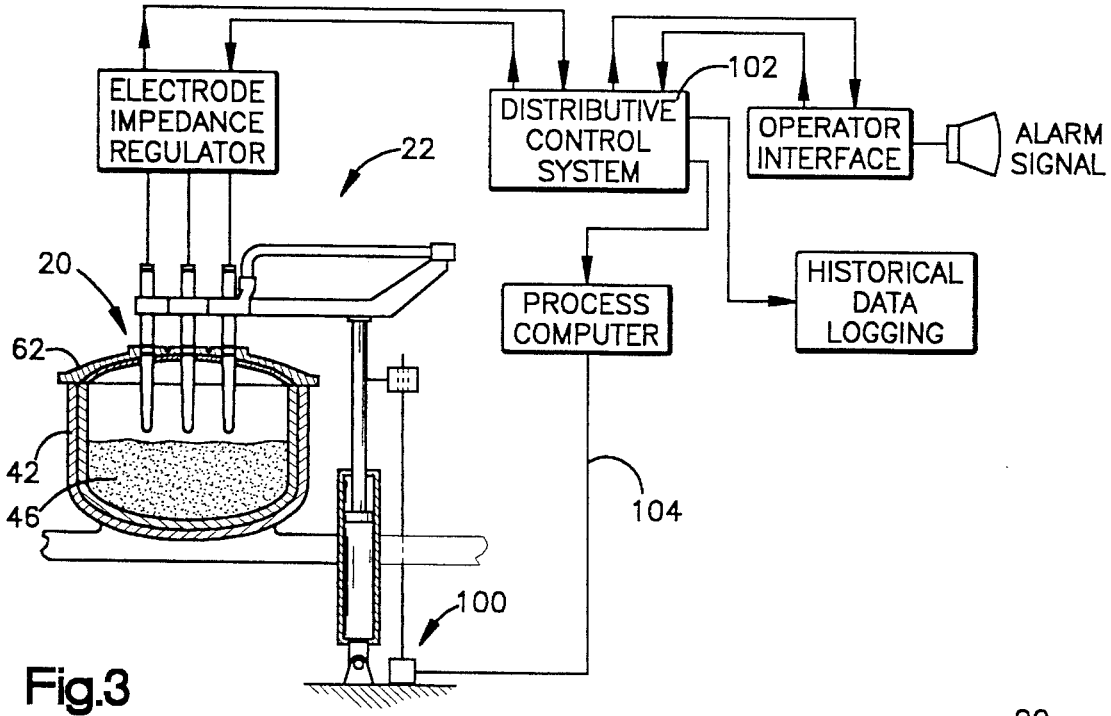
FIG. 3 is a schematic view of the furnace in FIG. 2, taken approximately along line 3—3 of FIG. 2.

An electric arc furnace 20 which is particularly suitable in a ladle refining operation for the production of carbon steel is illustrated in FIGS. 1 and 2. The furnace 20 includes an excessive electrode consumption analyzer 22 (FIG. 3) embodying the present invention. With the use of the excessive electrode consumption analyzer 22, steel alloy heats are provided from the furnace 20 that are closer to being "on chemistry" for carbon content, which results in less scrapping or corrective processing of undesired heats.

The furnace 20 includes a support superstructure 42 of a steel material (FIGS. 1–5) on its exterior and refractory lining material 44 (FIG. 4) on its interior. A charge 46 of steel material is placed in the furnace 20 that is to be reheated. The material of the charge 46 is typically a steel that is to be further processed or refined for chemistry or structure.

A lid 62 is swingable into place over the furnace superstructure 42 to contain the charge 46 while it is being refined. The lid 62 typically includes three openings 64 (FIG. 4) in its upper side for a respective carbon electrode 82 to extend through and reach a position near the charge 46. Each of the electrodes 82 is supported by a separate arm 84. Each arm 84 is movable vertically upwards and downwards in order to place the electrode 82 and its tip 88, or other arc generating portion, at a location in the furnace 20 suitable for reheating, such as slightly above the charge 46.

Each electrode 82 is electrically connected with a power source 90 (FIG. 4) by a respective conductor 86 which provides electric energy to the electrode which can then be delivered to the charge 46 in the form of an arc to reheat the charge. When the arc starts at each electrode 82, the support arm 84 is at an initial vertical position P1 at which reheating starts and the position is sensed by a position sensor 100. The initial position P1 can be an absolute position or reset to a relative position such as by zeroing. This initial position P1 is communicated to a processor/controller 102 over line 104 where it is stored.

During the transition from the initial unrefined charge 46 to the refined condition, the top surface level of the charge 46 remains substantially the same in the furnace 20 because the volume of the charge remains relatively constant. In order to maintain the desired refining condition of the charge 46, each electrode 82 is individually moved downwardly from the initial position P1 to another position P2 after the generated arc length AL, between each tip 88 of the electrode and the charge, is established and constant. Upon continual application of energy to each electrode 82 the respective electrode 82 is eroded or consumed. In order to maintain proper electrical energy delivery to the charge 46 by maintaining a relatively constant arc length AL, each arm 84 supporting an electrode 82 is controlled to continue to move downwardly.

Figure 4:
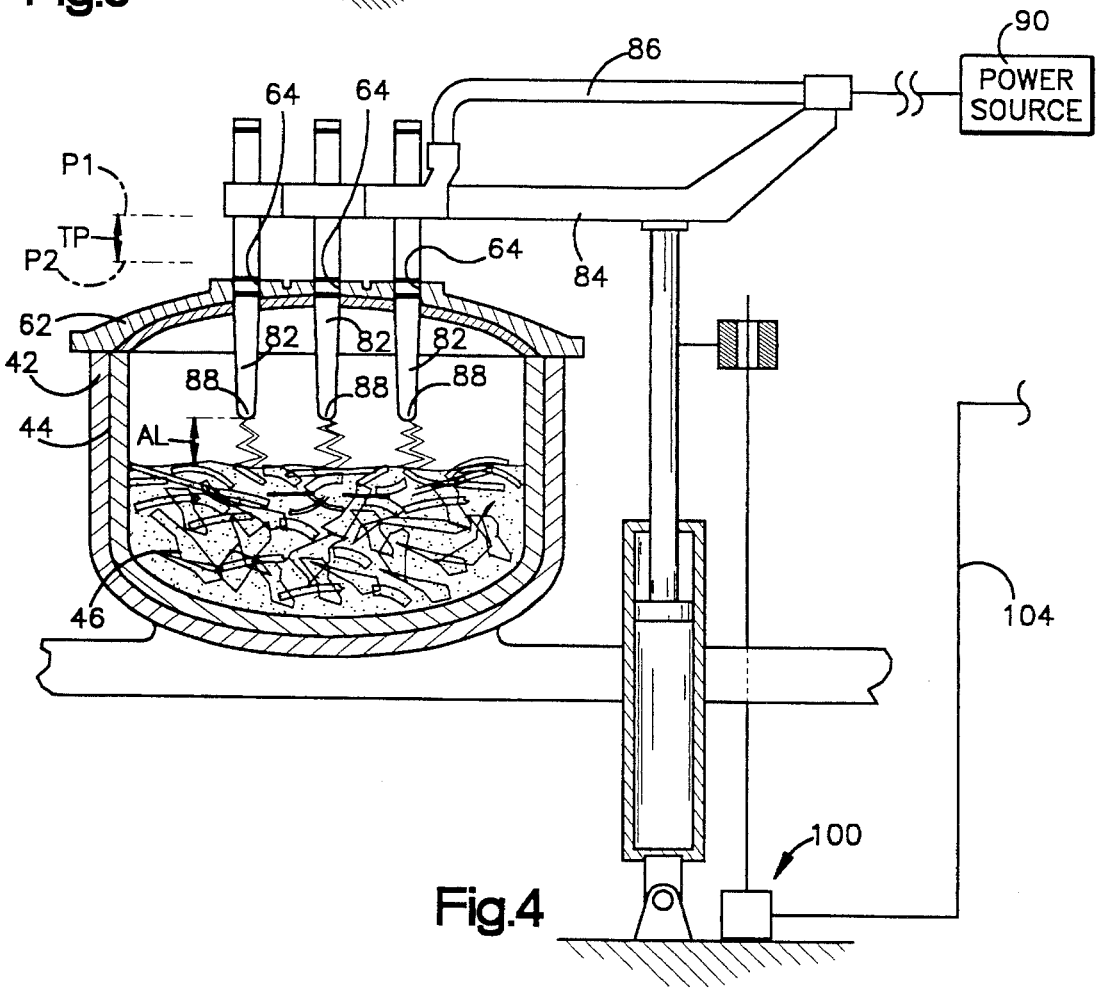
FIGS. 4 and 5 are enlarged cross-sectional views of a portion of the furnace in FIG. 3 with parts in different positions.
Figure 5:
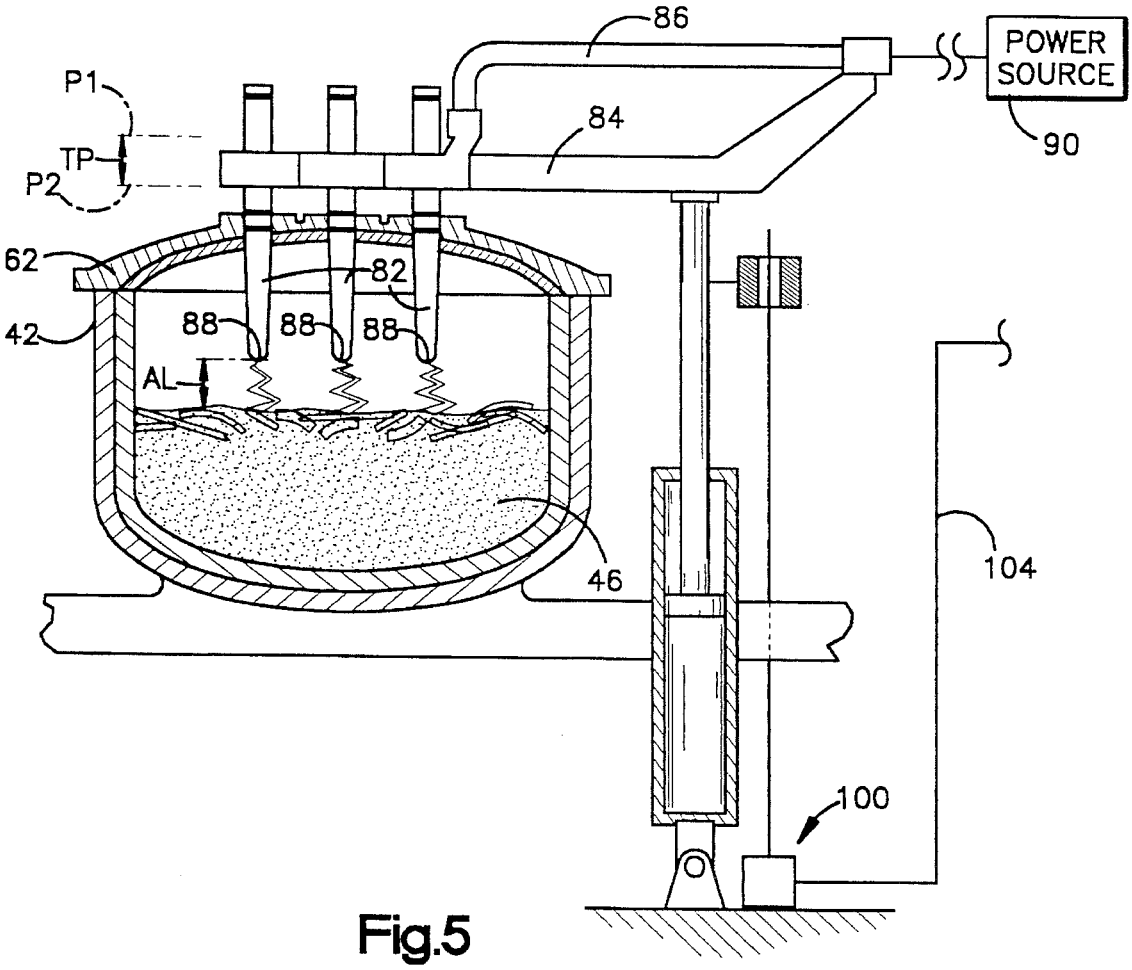

A position sensor 1134, as illustrated in FIG. 4, continually monitors the position P2 of each electrode support arm 84 traveled from the initial position P1. The position P2 is indicative of the amount of wear of the electrode 82. The difference between P1 and P2 is how much of the electrode is consumed. The position P2 of the support arm 84 is constantly communicated to a processor/controller 102. The processor/controller 102 calculates the total travel distance TD of the arm 84 from the initial position P1 by the formula TD=P2–P1. The calculation establishes total travel distance TD of the arm 84. This travel distance TD information can be used to calculate the electrode consumption data and to determine when an excessive carbon electrode consumption condition exists.

The total distance TD of movement of the support arm 84 may be used as a predictor of an excessive carbon electrode consumption condition existing. This condition exists when the calculated travel distance TD of an electrode 82 equals or exceeds a predetermined maximum threshold distance that is acceptable for a particular steel alloy heat. For example, in one form of the present invention when any of the support arms 84 combined, with a respective one of the three electrodes 82, moves a travel distance TD of ten inches from an arc starting or initial position P1 towards the charge 46, an excessive carbon electrode consumption condition is deemed to exist. In other words, an excessive consumption condition exists when there is 10" of total wear from the 3 electrodes. This threshold travel distance has been verified through experimentation which found that more than ten inches of travel distance TD of the support arm 84 for the consumption of any electrode 82 often results in an unacceptable chemistry for carbon content of the steel alloy heat being refined. It will be apparent that the criticality of this travel distance TD can vary depending on the quantity of steel produced in a given size of furnace 20 and the desired carbon content range of the steel alloy heat produced.

When an excessive carbon electrode consumption condition exists an alarm signal is generated by the processor/controller 102 and an operator can manually decrease the electrical power supplied to that particular electrode 82 or all electrodes. Alternatively, the alarm signal can be communicated to a power supply controller and the power automatically decreased as a function of the magnitude of excessive carbon electrode consumption established by the travel distance TD. For example, a travel distance TD of fourteen inches (four inches of excess travel from a threshold travel distance of ten inches) would reduce the power another tap setting or two as compared to a travel distance of twelve inches (two inches of excess travel).

Figure 6:
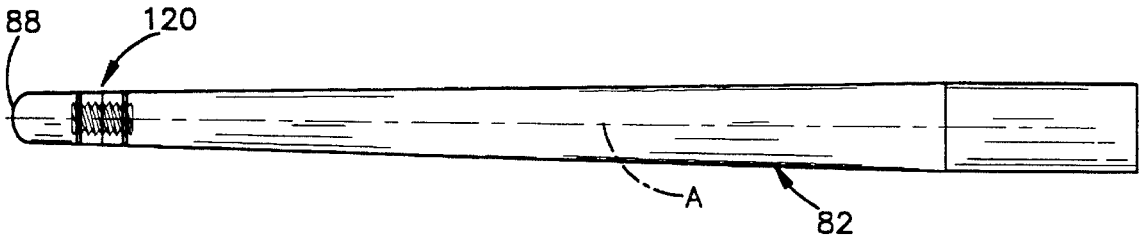
FIG. 6 is an enlarged elevational view of an electrode, partly in section, illustrating a butt joint.

Often excessive carbon electrode consumption exists when an electrode 82 is moved too quickly towards the charge 46 and it engages an upper surface of the charge 46 which typically has slag and the electrode becomes side loaded. Force can be applied transversely to the longitudinal central axis A (FIG. 6) of the electrode 82. Since the electrode 82 is typically very brittle and cannot often absorb the side loading it breaks. This breakage of the electrode 82 allows a relatively large amount of carbon to be introduced into the charge 46 which is eventually introduced into the steel alloy.

Another way excessive carbon electrode consumption exists is when a butt joint 120 is encountered as the arc generating region of the electrode 82. This butt joint 120 often provides more resistance than a continuous solid carbon electrode 82 and wears, or is consumed faster, into the charge 46 at a given power level. Thus, by reducing power supplied to the electrodes 82 with a butt joint 120 as the arc generating region, excessive electrode consumption is prevented at the butt joint.

The excessive carbon electrode consumption due to breakage of the electrode 82 and encountering a butt joint 120 at the arc generating region can be recorded but generally cannot be completely eliminated or controlled by reducing the power applied to the electrode. The reduction in power is most beneficial for reducing the consumption of the electrode 82 during the normal reheating process where variables such as steel and slag chemistries and slag volume or thickness cause varying rates of electrode consumption or wear. These extraordinary excessive consumption conditions are the subject of ongoing testing and modeling.

In another form of the present invention the processor/controller 102 can use the travel distance TD or position information to calculate a rate of consumption, such as a rate in inches of electrode 82 consumed per unit time based on the travel distance TD of the support arm. The processor/controller 102 can calculate a rate of electrode consumption RC in inches per unit time and compare that calculated value with a maximum threshold consumption rate for a particular steel alloy heat. When the calculated consumption rate RC equals or exceeds the threshold consumption rate, an excessive carbon electrode consumption condition exists. When this consumption rate RC exceeds the predetermined threshold rate of consumption of the electrode 82, the alarm signal is generated and again an operator can decrease the power or an electronic controller can automatically decrease power to that electrode 82 so the rate of electrode consumption is reduced and the resultant chemistry for carbon content of the steel heat falls within the desired allowable ranges for a given grade of steel chemistry. It is further contemplated that the amount of power reduction can be accomplished as a function of the magnitude of the rate of excess electrode consumption.

From the above description of preferred embodiments of the invention, those skilled in the art will perceive improvements, changes and modifications. Such improvements, changes and modifications within the skill of the art are intended to be covered by the appended claims.

Having described at least one preferred embodiment of the invention, what is claimed is:

1. In an electric arc furnace for heating a charge contained therein including at least one electrode projecting into the furnace and an electrode support structure for moving the electrode in a direction towards and away from the charge, the improvement comprising:

a sensor for detecting the position of the electrode support structure after the electrode reaches an initial starting position in the furnace;

a processor for calculating one of an electrode support structure travel distance from the initial starting position and a rate of electrode consumption; and a signal generator for generating an alarm signal when one of said travel distance and said electrode consumption rate is at least as great as one of an associated predetermined threshold travel distance and a predetermined threshold rate of electrode consumption, wherein said alarm signal is indicative of an excess electrode consumption condition for a given heat.

2. The improvement of claim 1 further including a power reducer for decreasing electrical power supplied to the electrode in response to the generation of said alarm signal.

3. The improvement of claim 2 further including said processor calculating a magnitude of excess electrode consumption as the difference of the electrode support structure travel distances less the predetermined threshold travel distance and further including said power reducer having means for automatically decreasing the electrical power supplied to the electrode as a function of the magnitude of excess electrode consumption.

4. In an electric arc furnace for heating a charge contained therein including at least one electrode projecting into the furnace and electrode support structure for moving the electrode in a direction along a path towards and away from the charge, the improvement comprising:

a sensor for detecting the position of the electrode support structure with respect to an initial starting position in which an electric arc is generated from the electrode;

a processor for calculating a distance of electrode support structure travel from the initial starting position and a rate of electrode consumption; and a signal generator for generating an alarm signal when one of said travel distance and said electrode consumption rate are equal to or larger than an associated one of a predetermined threshold travel distance and a predetermined threshold rate of electrode consumption, wherein said alarm signal is indicative of an excess electrode consumption condition for a given heat.

5. The improvement of claim 4 further including a power reducer for decreasing electrical power supplied to the electrode in response to said alarm signal.

6. The improvement of claim 5 wherein said power reducer comprises means for automatically decreasing the electrical power supplied to the electrode as a function of a magnitude of excess electrode consumption.

7. In an electric arc furnace for heating a charge contained therein including at least one electrode projecting into the furnace and electrode support structure for moving the electrode in a direction along a path towards and away from the charge, the improvement comprising:

a sensor for detecting the position of the electrode support structure with respect to an initial starting position;

a processor for calculating one of a travel distance of the electrode support structure from the initial starting position, which is indicative of the amount of electrode consumed, and a rate of electrode consumption;

a signal generator for generating an alarm signal when one of said travel distance and said electrode consumption rate is at least equal to an associated one of a predetermined threshold travel distance and a predetermined threshold rate of electrode consumption, wherein said alarm signal is indicative of an excess electrode consumption condition for a given heat; and a power reducer for automatically decreasing electrical power supplied to the electrode in response to said alarm signal and as a function of a magnitude of the excess electrode consumption condition.

8. A method of heating a charge in an electric arc furnace that includes at least one electrode projecting into the furnace and electrode support structure for moving the electrode in a direction along a path towards and away from the charge, said method comprising the steps of:

determining a position of the electrode support structure with respect to an initial starting position;

calculating one of a support structure travel distance and a rate of electrode consumption; and generating an alarm signal when one of the travel distance and the electrode consumption rate is at least equal to an associated one of a predetermined threshold travel distance and a predetermined rate of electrode consumption, wherein said alarm signal is indicative of an excess electrode consumption condition for a given heat.

9. The method of claim 8 further including the step of decreasing electrical power supplied to the electrode when said alarm signal being generated.

10. The method of claim 9 wherein said decreasing step includes the step of automatically decreasing the electrical power supplied to the electrode as a function of a magnitude of excess electrode consumption.

11. The improvement of claim 1 wherein said signal generator is adapted to generate said alarm signal when said electrode consumption rate is at least as great as said predetermined threshold rate of electrode consumption.

12. The improvement of claim 4 wherein said signal generator is adapted to generate said alarm signal when said electrode consumption rate is at least as great as said predetermined threshold rate of electrode consumption.

13. The method of claim 8 wherein said alarm signal is generated when the electrode consumption rate is at least equal to said predetermined rate of electrode consumption.

* * * * *